US006012462A

United States Patent [19]

Schmittou

[11] Patent Number: 6,012,462

[45] Date of Patent: Jan. 11, 2000

[54] HAND HELD DEVICE FOR DELIVERING A PLURALITY OF HAIR COLOR FORMULAS TO HUMAN HAIR

[76] Inventor: Rodney L Schmittou, P.O. Box 244, Guerneville, Calif. 95446

[21] Appl. No.: 09/290,369

[22] Filed: Apr. 12, 1999

[51] Int. Cl.[7] ..... A45D 24/22; A45D 7/02; A46B 11/02

[52] U.S. Cl. ..... 132/113; 132/115; 132/112; 132/212; 401/188

[58] Field of Search ..... 132/113, 114, 132/115, 112, 212, 147; 222/132, 136, 400.7, 401; 239/337, 303; 401/188, 46, 47, 48

[56] References Cited

U.S. PATENT DOCUMENTS

| | | | |
|---|---|---|---|
| 2,960,710 | 11/1960 | McKeegan | 401/46 |
| 3,640,630 | 2/1972 | Wlake | 401/188 |
| 4,140,410 | 2/1979 | Grace | 401/46 |
| 4,546,922 | 10/1985 | Thometz | 401/46 |
| 5,445,596 | 8/1995 | Grace | 401/46 |
| 5,466,080 | 11/1995 | Lee | 401/7 |
| 5,695,293 | 12/1997 | Chase | 401/44 |

*Primary Examiner*—John J. Wilson
*Assistant Examiner*—Robyn K. Doan

[57] ABSTRACT

This is a device that will allow the user to apply four different hair color formulas simultaneously. The device has four color containers inverted on the top of the device. Air pressure is applied through the air pump in the handle, which increased the pressure in the color containers that are threaded into the base. The pressure forces the color product through the color tubes out to the color applicator. The entire device is drawn from the base of the hair to the ends of the hair.

3 Claims, 2 Drawing Sheets

HAND HELD DEVICE FOR DELIVERING A PLURALITY OF HAIR COLOR FORMULAS TO HUMAN HAIR

CROSS-REFERENCE TO RELATED APPLICATIONS

Not Applicable.

REFERENCE TO A MICROFICHE APPENDIX

Not Applicable.

STATEMENT REGARDING FEDERALLY SPONSORED RESEARCH OR DEVELOPMENT

Not Applicable.

BACKGROUND OF INVENTION

1. Field of invention

This invention relates to, but not limited to, the field of cosmetology, and hair coloring, It is a device for applying a plurality hair color formulas to human hair, simultaneously 2. Background of the invention Many devices have been developed to apply or section hair for color application. However, none have been able to apply more than one color at one time. Normally color is applied one formula at a time, to one section of hair. During my career as a cosmetologist, there have been many times I have had to do three or four complete color applications in order to achieve the desired effect. This invention fills a need that currently goes unheeded. This is an easy convenient way to achieve a multi-dimensional hair color in one application.

BRIEF SUMMARY OF THE INVENTION

It is the primary objective of this invention to provide an easy and convenient way to achieve a broader range of color, in just one application. In accordance with an important aspect of the invention, a hand pump, or a regulated pressurized air container, is located in the handle. The color containers are attached inverted to the top of the device via threaded insets on the base.

In accordance with a further aspect of the invention, the color product is transferred from the color containers to the applicator comb by removable soft plastic tubes. These may be re-arranged on the applicator in order to offer even more variations of color application.

Briefly, the invention is a device for applying four different color formulas to human hair, in a variety of patterns. The device is "gun-like" in as much as it has a handle and trigger. The four different color formulas are stored on the top of the device, and moved into the applicator comb using air pressure. By pressing the "trigger" and moving the applicator comb from the base of a section of hair, through to the ends, you will be applying the colors in twelve separate "streaks".

Further aspects and advantages of this invention will become apparent from the following detailed description, claims and accompanying drawings.

DETAILED DESCRIPTION OF THE INVENTION

Figure 1:
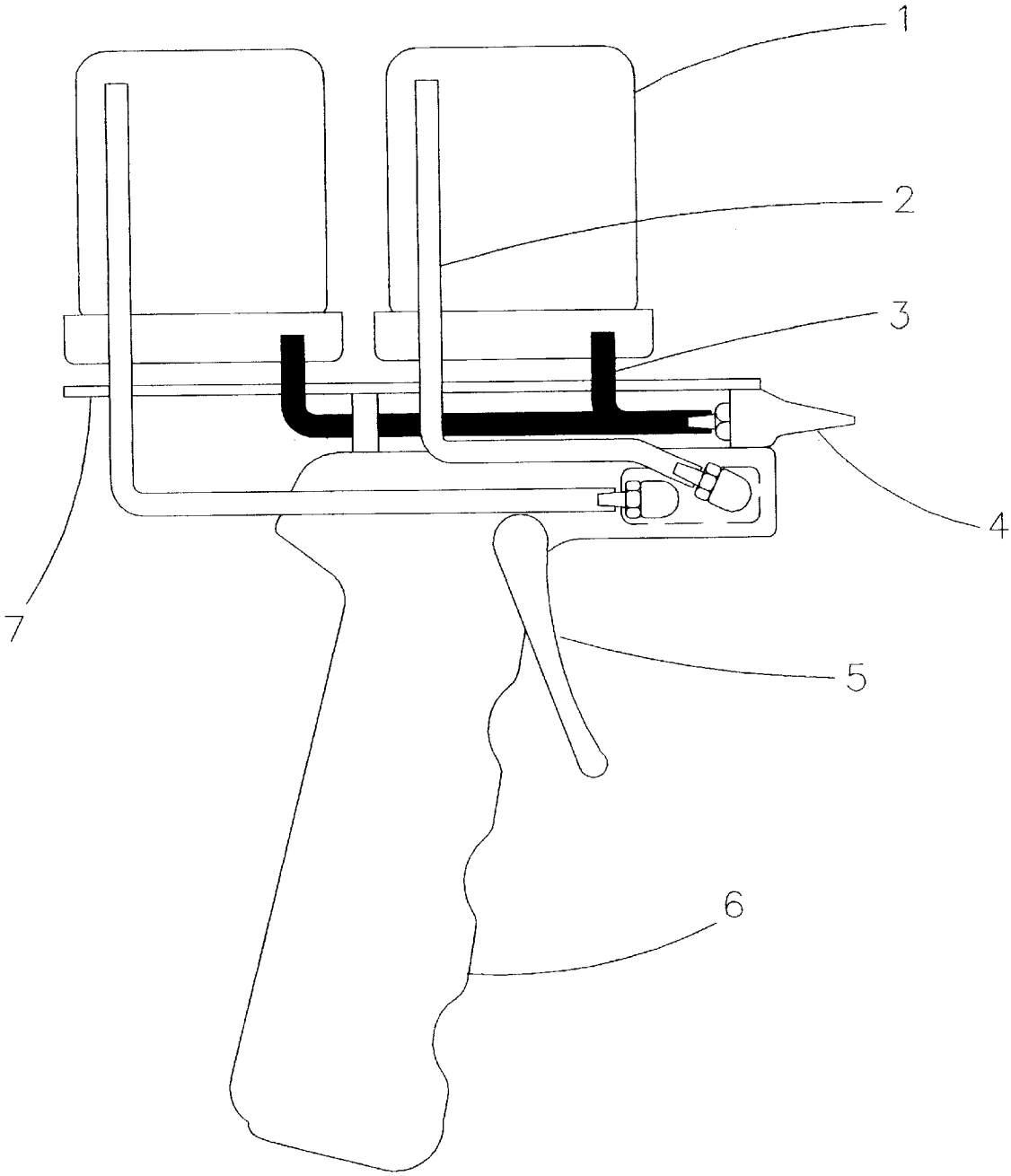
FIG. 1 is a side view of the multi-color application device.
Figure 2:
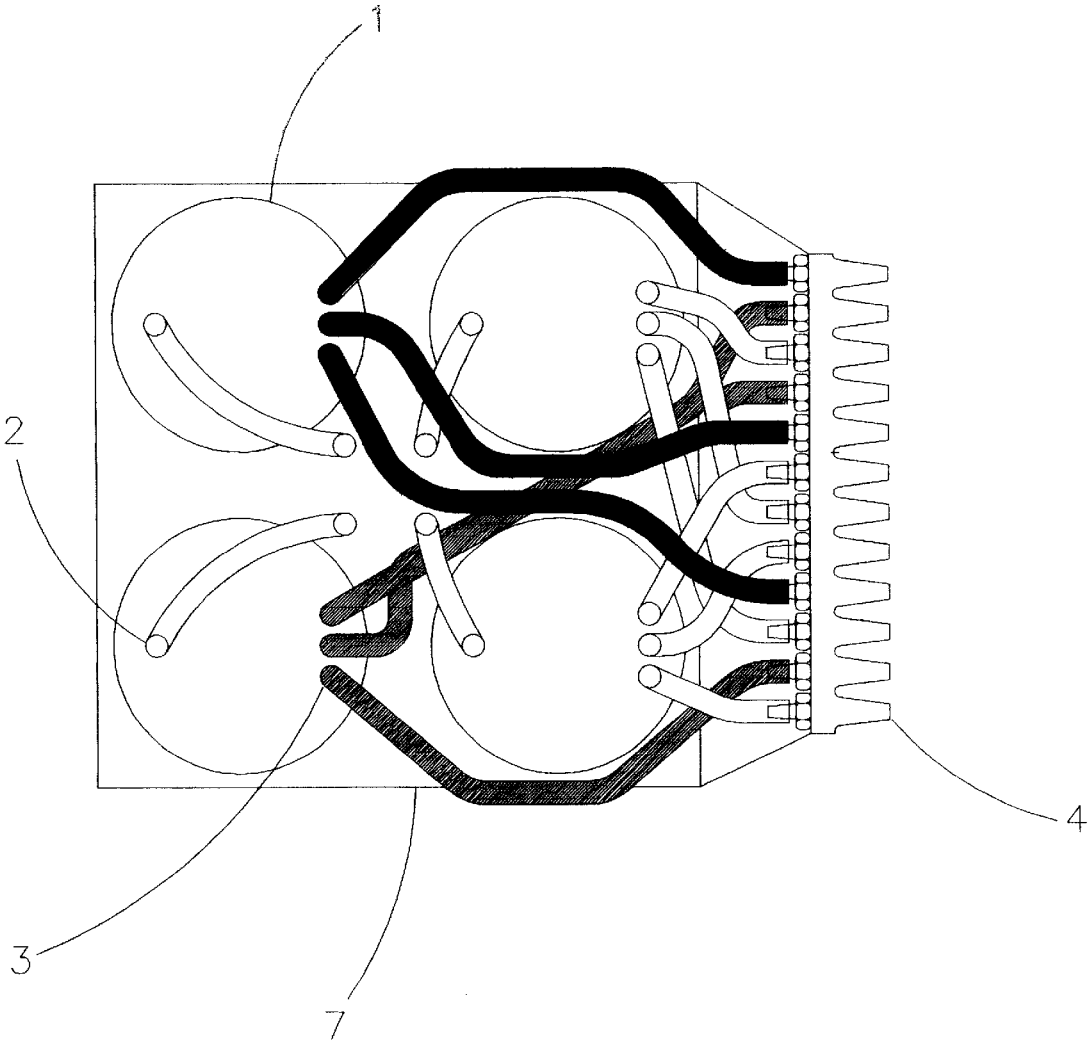
FIG. 2 is a top view of the device of FIG. 1.

Referring more specifically to the drawings, there is in FIG. 1, a device to apply four different color formulas at the same time. The base (7) and handle (6) are constructed of molded hard plastic. The air pressure tubes (2) are a ridged plastic and are attached to the hand pump(5) which could also be a regulated pressurized air container in the handle (6). Hair coloring product is placed in the threaded color containers (1) that attach by screwing to the base (7). This is accomplished by turning the base (7) upside down, and the color containers (1) are threaded and screw to the base (7) Air pressure is then applied and forces the color product out through the color tubes (3) FIG. 2, which are made of a pliable plastic, and connect to the comb applicator (4) FIG. 2. You will notice that on page 2, the color tubes (3) are of different lengths. Since the completion of the drawings, I have decided that the color tubes (3) should all be the same length to ensure that all four colors reach the applicator comb (4) at the same time.

The entire device is drawn from the base of the hair shaft, through to the end of the hair strands, evenly applying the four different hair color formulas to the hair in twelve distinct streaks. When a section of hair has been completed, the release of the air pump, or in the case of the pressurized air model, the trigger, will stop the flow of the hair coloring product. The device can then be placed on the stand until needed for the next section of hair.

What is claimed is:

1. A device for simultaneously applying a plurality of different hair color formulas at one time comprising a base, a handle having an air pump, a plurality of inverted color containers on top of said base, a plurality of air pressure tubes connected to the air pump delivering air pressure to said containers, said air pressure forces said color formulas to a color applicator, an applicator having apertures for applying the color formulas to a section of hair and a plurality of second plastic tubes connecting said color containers to said applicator, whereby air pressure delivered to said containers by said air pressure tubes forces the color formulas through said second plastic tubes to said applicator and through said applicator apertures to the section of hair.

2. A device according to claim 1 wherein said air pump is a regulated, pressurized air container.

3. A device according to claim 1 having three color containers.

* * * * *